United States Patent [19]

Olsson et al.

[11] Patent Number: 4,903,516

[45] Date of Patent: Feb. 27, 1990

[54] ROLLING MILL MACHINE FOR LONGITUDINAL BENDING OF PLATE

[75] Inventors: Sven O. Olsson, Huddinge; Lars J. Rudman, Farsta, both of Sweden

[73] Assignee: Dobel AB, Borlänge, Sweden

[21] Appl. No.: 255,552

[22] Filed: Oct. 7, 1988

[30] Foreign Application Priority Data

Oct. 9, 1987 [SE] Sweden ..... 8703922

[51] Int. Cl.[4] ..... B21D 5/08; B21D 13/04

[52] U.S. Cl. ..... 72/181; 72/226

[58] Field of Search ..... 72/176, 179–182, 72/164, 226, 234, 238

[56] References Cited

U.S. PATENT DOCUMENTS

| | | | |
|---|---|---|---|
| 819,644 | 5/1906 | Flatau | 72/181 |
| 2,649,888 | 8/1953 | Fay | 72/176 |
| 3,009,511 | 11/1961 | LeBouef | 72/181 |
| 3,453,852 | 7/1969 | Valente | 72/164 |
| 3,777,531 | 12/1973 | McClain | 72/226 |

FOREIGN PATENT DOCUMENTS

| | | | |
|---|---|---|---|
| 8704375 | 7/1987 | European Pat. Off. . | |
| 2816993 | 10/1979 | Fed. Rep. of Germany | 72/181 |

*Primary Examiner*—Daniel C. Crane

*Attorney, Agent, or Firm*—Nils H. Ljungman

[57] ABSTRACT

A rolling mill machine is for longitudinal bending of plate to selectively provide one of at least two cross-sectional profiles. The machine includes a plurality of shaping stations extending transversely of the plate with at least one drive station for advancing the plate through the plurality of shaping stations. Each of the shaping stations has a first forming element on one side of the plate and a second forming element on the other side of the plate. The first forming element has at least a first set of non-driven forming rolls and a second set of non-driven forming rolls. The second forming element has a plurality of non-driven forming rolls. The first forming element is selectively moveable to position at least one of the first and the second sets thereof for bending of the plate. The rolls of at least one of the first set and the second set are disposed for forming the plate on one side and the rolls of the second forming element are disposed for forming on the other side. The first set of rolls of the first forming element is for cooperating with the rolls of the second forming element to bend the plate to form a first of the cross-sectional profiles while the second set of rolls of the first forming element is for cooperating with the rolls of the second forming element to bend the plate to form a second of the cross-sectional profiles.

18 Claims, 2 Drawing Sheets

ROLLING MILL MACHINE FOR LONGITUDINAL BENDING OF PLATE

BACKGROUND OF THE INVENTION

1. Field of the Invention:

The invention relates to a rolling mill machine for longitudinal profile bending of thin plate and, more specifically, to such a machine for the manufacturing of building plates with selectively different trapezoidal cross sections. The basic machine includes a number of shaping stations with free-rolling work rolls. Separate from the shaping stations, drive stations are employed for feeding the strip through the shaping stations. The work rolls in each shaping station are disposed in rows extending transversely across the strip with one row on one side of the strip being aligned with another row on the other side of the strip. The work rolls on the one side of the strip are spaced laterally between the work rolls on the other side so that the strip is shaped by means of free-forming therebetween.

2. Description of the Prior Art:

German Laid Open Patent Appln. No. 29 41 180 discloses one type of rolling mill configuration employed to form plate with a trapezoidal cross section. The work rolls disclosed therein are adjustable both horizontally and vertically to allow production of different profiles. However, to eliminate any requirement to change the rolls, the shaping is done in two stages. Initially, the plate is pre-shaped to form a round, corrugated profile with the finished width for the strip. A final stage includes shaping to the desired trapezoidal profile without the width of the strip or plate being changed. The final shaping step is replaced when changing to another profile. The adjustments between pre-rolling and finish rolling require capable personnel to insure that the change is not too time-consuming.

In PCT International Published Application No. WO 87/04375, a free-forming rolling machine is disclosed in which the work rolls are mounted in pairs on beams which are oriented at right angles to the strip's direction of movement. Different profile forms can be obtained by shifting the pairs of work rolls along the beams and by internal adjustment of the rolls of the pair. Presumably, test runs are then required as well as fine-tuning before the production run of each new profile form.

In German Laid Open Patent Appln. No. 28 16 993, a shaping machine is described which has, in the conventional manner, whole profiled and driven rolls which both form and drive the strip. The machine includes different sets of rolls which can be indexed into operative position but would appear to require relative fine-tuning for satisfactory operation.

Although U.S. Pat. No. 4,136,545 discloses a configuration for changing the rolls by rotating them, there does not appear to include such changing for the purposes of changing the profile.

The above-mentioned German Patent Application and U.S. Pat. No. 4,136,545 are incorporated by reference as if they are included in their entirety herein.

OBJECTS OF THE INVENTION

It is an object of the invention to provide a rolling mill machine capable of selectively forming plates of different cross sections.

It is another object to provide such a machine which can be conveniently and simply changed to form the different plates.

It is still another object to provide such a machine which is inexpensive and requires no special adjustments to change the cross section of the plate.

SUMMARY OF THE INVENTION

These and other objects of the invention are provided in a preferred embodiment thereof including a rolling mill machine for longitudinal bending of plate to selectively provide one of at least two cross-sectional profiles. The machine includes a plurality of shaping stations extending transversely of the plate with at least one drive station for advancing the plate through the plurality of shaping stations. Each of the shaping stations has a first forming element on one side of the plate and a second forming element on the other side of the plate. The first forming element has at least a first set of non-driven forming rolls and a second set of non-driven forming rolls. The second forming element has a plurality of non-driven forming rolls. The first forming element is selectively moveable to position at least one of the first and the second sets thereof for bending of the plate. The rolls of at least one of the first set and the second set are disposed for forming the plate on one side and the rolls of the second forming element are disposed for forming on the other side. The first set of rolls of the first forming element is for cooperating with the rolls of the second forming element to bend the plate to form a first of the cross-sectional profiles while the second set of rolls of the first forming element is for cooperating with the rolls of the second forming element to bend the plate to form a second of the cross-sectional profiles.

According to the invention an inexpensive and simple machine is obtained which provides a fast and adjustment-free change between different profiles. The invention is characterized by the fact that in each of the shaping stations the row of work rolls on one side of the strip or plate is supported by a first rotatable beam, which must support also at least one other row of work rolls. The work rolls of both of these two rows may respectively extend at different distances from the rotating shaft of the first beam. The row of work rolls on the other side of the strip is supported by another rotatable beam, which also supports at least one other row of work rolls. The work rolls in these two rows extend an equal distance from the rotatable shaft of the other beam and in operative position form a jointly operating surface with the corresponding rolls in the other shaping stations. The rotatable beams are lockable in alternate positions, so that one of the rows of rolls is in operative position while the other one or more rows are swung away out of operative position.

Through an appropriate choice of profiles one can obtain more profiles than the number of rows of work rolls on the rotatable beams. Theoretically one can obtain profiles equal in number to the product of the number of rows on both rotatable beams in one shaping station.

A machine with four rows of rolls on each rotatable beam in one shaping station can thus result in more than four different profiles, although in the normal case four such profiles would be satisfactory.

Preferably, the machine is designed so that the drive stations are placed between the shaping stations and include one drive roll over the whole width of the strip and a number of rows of counter rolls which are mounted on a rotatable beam. Changing the drive stations can thereby be as quick as changing the shaping stations and a complete change of the machine can be done many times during one shift of operating the machine.

DESCRIPTION OF THE PREFERRED EMBODIMENTS

Figure 1:
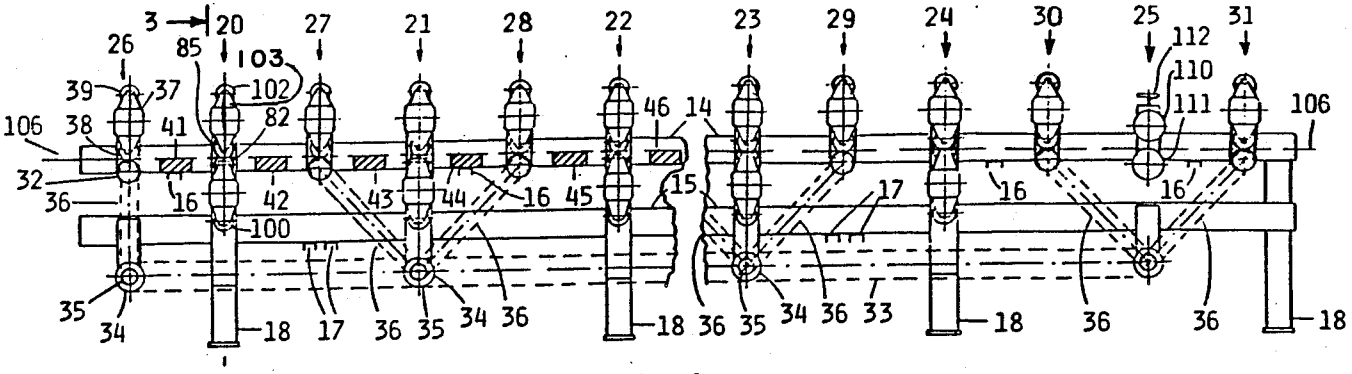
FIG. 1 is a side elevational view of a preferred rolling mill machine according to the invention as generally seen along line 1—1 in FIG. 2.
Figure 2:
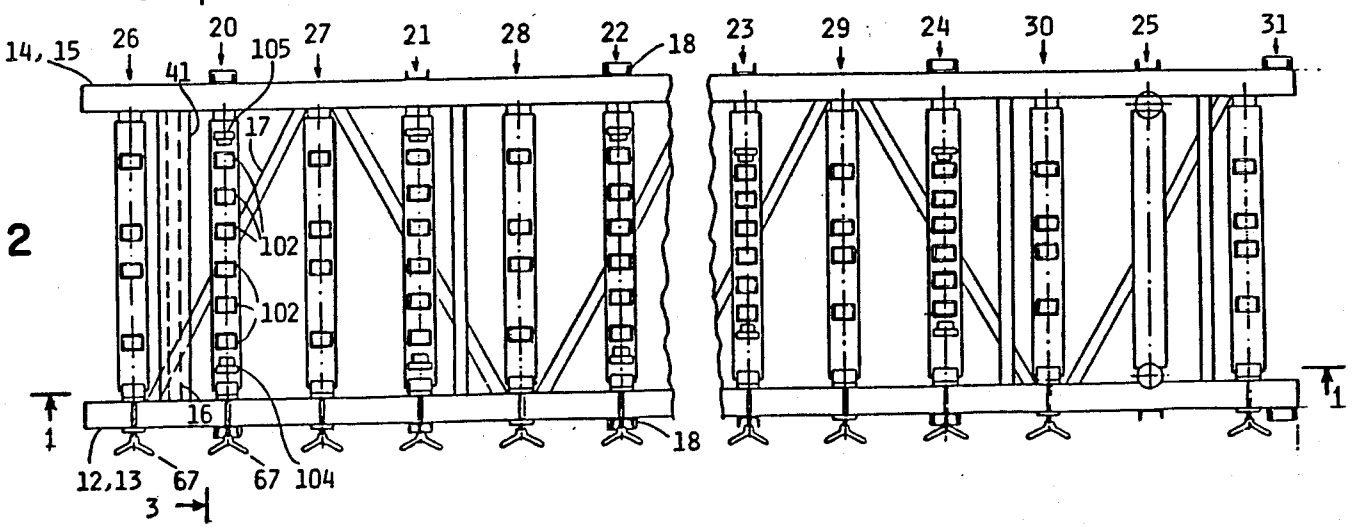
FIG. 2 is a top view of the machine shown in FIG. 1.
Figure 3:
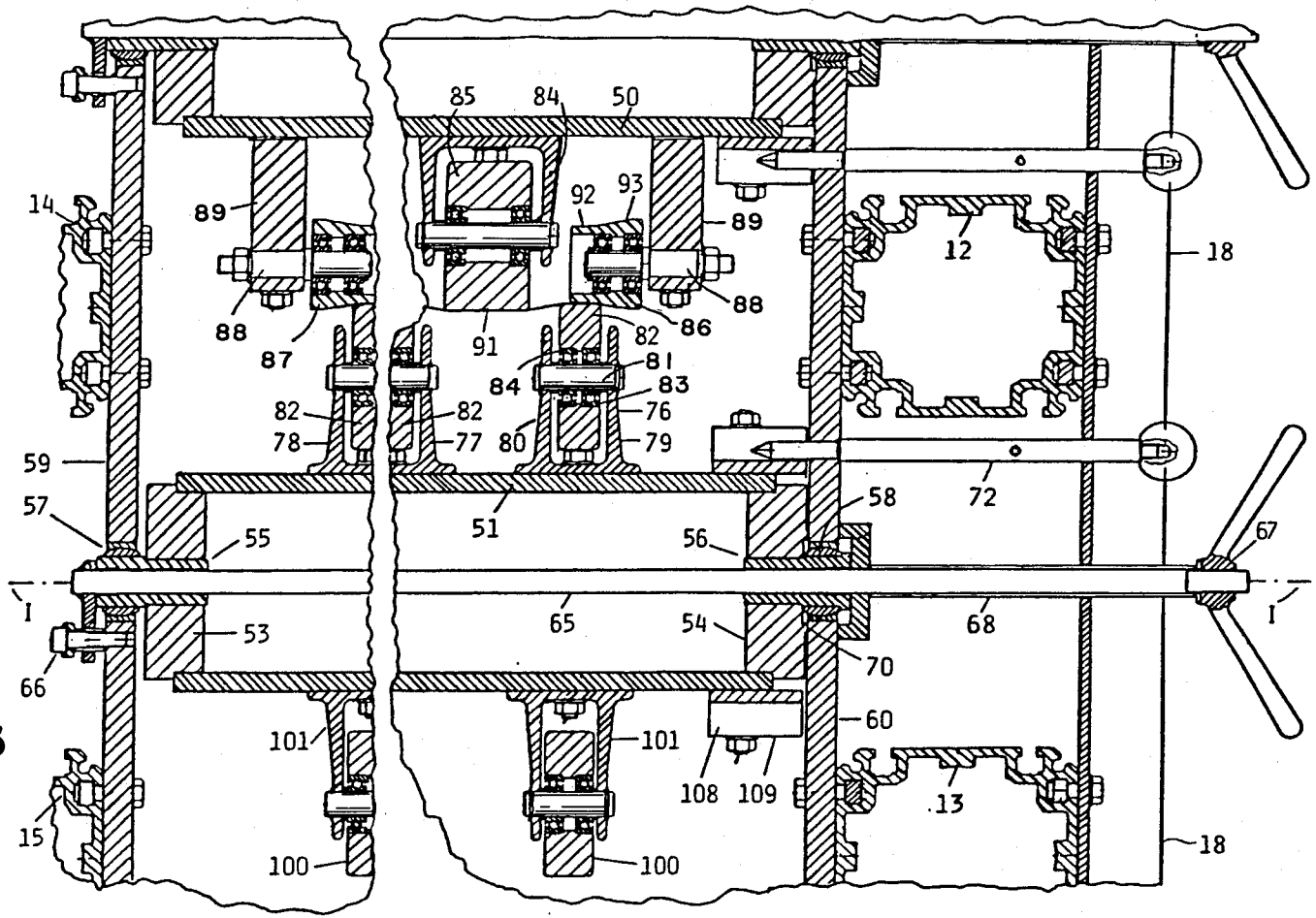
FIG. 3 is a fragmentary section taken along the line 3—3 in FIGS. 1 and 2.

The preferred rolling machine, as seen in FIGS. 1, 2 and 3, includes a housing, the chief parts of which are made up of an upper longitudinal beam 12 and lower longitudinal beam 13 on one side of the machine and a corresponding upper beam 14 and lower beam 15 on the other side of the machine. A plurality of posts 18 at each side respectively support and hold together the upper and lower beams 12, 13 and 14, 15. Additionally, the upper beams 12, 14 are held together by a plurality of cross-tie beams 16 while the lower beams 13, 15 are held together by a plurality of cross-tie beams 17, as shown in FIGS. 1 and 2.

Within the housing of the preferred machine, a number of shaping stations have been provided with only the first three stations 20–22 and the last two stations 23, 24 being shown. The midsection of the machine, which has, for example, about eight shaping stations, has been cut away in FIGS. 1 and 2. A calibration station 25 with cylindrical full-width rolls 110, 111 is installed to follow the final shaping station. A plurality of drive stations 26–31 are located between the shaping stations and serve as the first and last station of the preferred machine.

The drive stations 26–31 are principally alike and an explanation of the first drive station 26 as seen in FIGS. 1 and 2 will be applicable for the other drive stations 27 through 31. Each of the drive stations 26–31 includes a lower cylindrical drive roll 32, which is provided with a rubber coating to increase the friction. The drive rolls 32 are driven in tandem by a motor (not shown) through a drive chain 33 which rotates a number of sprocket wheels 34. The sprocket wheels 34 share a shaft with smaller sprocket wheels 35, which respectively rotate the drive sprocket wheels of the drive rolls 32 through short chains 36. The chains 33, 36, which are shown in FIG. 1 with broken lines, are located next to the beams 14, 15. However, in order to simplify FIG. 2, the drive chains and the sprocket wheels have been left out of FIG. 2. The drive stations all include an upper rotatable box beam 37 in which there is a row of free-rolling counter rolls 38 which are aligned with and run against the drive rolls 32. The box beam 37 in each drive station is rotatable so that another row of free-rolling counter rolls 39 can be rotated down into an operative position against the drive rolls 32 by a means which shall be described for the shaping stations.

Support tables 41–46 are respectively located between each of the first six alternating drive and shaping stations. The support tables 41–46 are secured to and extend between the upper longitudinal beams 12, 14.

The shaping stations 20–24 are similar to each other except for the particular placement of the freely rotating rolls thereon which vary as described below. The shaping station 20 shown in detail in FIG. 3 includes various parts which are included in all of the other shaping stations 21–24. Each of the shaping stations 20–24 is comprised of an upper horizontal, transverse, rotatable box beam 50 and a lower horizontal, transverse, rotatable box beam 51 which respectively have square cross-sections.

Each of the box or rotatable beams 50, 51, have flanges or end plates 53, 54 with journals 55, 56. The journals 55, 56 are respectively secured by means of ball bearings 57, 58 in vertical keeper plates 59, 60 respectively secured to the beams 14, 15 and 12, 13.

Rods 65 extending through the journals 55, 56 are locked against turning by bolts 66 which extend into holes in the vertical beam 59. Threaded handles 67 and spacer sleeves 68 on the rods 65 are used to axially position the box beams 50, 51 as bosses 70 thereon are tightened against the vertical keeper plate 60. Locking pins 72 catch in a key slot 73 in a block 74 to prevent the box beams 50, 51 from turning. The locking pins 72 are spring-loaded in catch position.

The lower rotatable beam 51 may include, for example, seven brackets which are mounted with screws. As seen in FIG. 3, only one bracket 76 is completely shown while fragmentary halves of two brackets 77, 78 are included. The remaining brackets are omitted with the corresponding intermediate region of the beam 51 which is omitted from FIG. 3. Each of the brackets has two wings 79, 80, as is indicated on bracket 76, and a shaft 81 which extends through holes in the wings 79, 80. A roll 82 is mounted on the shaft 81 with axially spaced, double bearings 83, 84 so that it is free-rolling but remains axially aligned on the shaft 81.

The upper rotatable beam 50 includes, for example, a row with six brackets 84 with rolls 85 attached thereto. The number of brackets in the row is one less than those provided for beam 51 in order to be properly disposed therebetween. Again, only one bracket and one roll are seen in FIG. 3. The rolls 85 are aligned laterally between the rolls 82. As a result, the strip 91, which is to be formed by so-called free-forming, is formed without being squeezed between two opposing rolls as with conventional shaping.

At both outer sides of the rotatable beam 50, there are two edge rolls 86, 87 similarly mounted with axially spaced, double bearings on fixed shafts 88 secured in brackets 89. A cylindrical part 92 of each edge roll 86, 87 is directly aligned with the corresponding exterior of rolls 82 at the outer ends of the rotatable beam 51 with the strip 91 being guided therebetween. The outer edges of the strip 91 are formed by the outer cut-off conical sections 93 of the edge rolls 86, 87.

The lower rotatable beam 51 has a second row of brackets 101 and rolls 100, as best seen in FIG. 3, which are intended for the production of another profile. Similarly, the upper rotatable beam 50 has a corresponding second row of rolls 102 in the bracket 103 as shown in FIGS. 1 and 2. The edge rolls 104, 105 in this row of rolls 102 can be seen in FIG. 2.

As seen in FIG. 1, all the rolls of the upper rotatable beam of the shaping stations 20–24 (rolls 85 and rotatable beam 50 of FIG. 3) which are in an operative position touch a horizontal plane 106, designated by broken lines. The plane 106 also touches all of the drive rolls 32 and their counter rolls 38 of the drive stations 26–31.

The plane 106 defines an entry plane for the flat strip or plate and a delivery plane for the finished, profiled strip. In other words, the plane 106 is the plane at which the lower region of the profile flanges lie with the remainder of the profile extending thereabove. An entry table and delivery table in the plane 106 can be made separate from the machine and are not shown on the figures. The support tables 41–46 also lie in the plane 106.

The lower drive rolls 32 and the counter rolls 38 of the drive stations 26–31 thus clamp the lower regions of the profile flanges of the strips 91 therebetween. The bearing or clamping pressure is adjustable with springs (not shown) in a manner well known by those skilled in the metal-forming art. As generally shown in FIG. 2, the counter rolls are not needed in every lower flange. There can be, by way of example, only four counter rolls even though six work rolls are employed to create six lower flanges.

As seen from the top view of FIG. 2, the strip would be flat before feeding in at the left. The same strip is formed into a finished strip (trapezoidally profiled) following delivery to the right of the machine. The width of the strip decreases successively in the shaping stations just as its profile height successively increases in the shaping stations. As a result, the lateral distance between adjacent rolls at each shaping station (from left to right) progressively decreases as the narrowing strip is being formed. A similar decrease in distance between the adjacent counter rolls is provided at the drive stations therebetween.

The ability to change the preferred machine to form another profile shall now be described. Changing of all rotatable beams in the shaping stations 20–24 and the drive stations 26–31 (those rotatable beams for the counter rolls) proceeds in the same way as shall be described with reference to FIG. 3 and beam 51.

First the threaded handle 67 is loosened and the locking bolt 72 is withdrawn. The beam is then rotated around the turning shaft axis I so that the row of rolls 82 is swung out of the operative position into an inoperative position and the row of rolls 100 is swung out of its inoperative position into the operative position. Thereafter, the locking bolt 72 is slipped into a key slot 108 in a block 109 to fix the turning position of the rotating beam 51 and the nut 67 is tightened down to axially fix the rotating beam 51. Often the other beam 50 must be loosened before the beam 51 can be turned to its final position, since one or more of the rolls 85, 86, 87 on the upper beam 50 can be in the way.

Thereafter the beam 50 is turned and fixed in the same manner with the rolls 102 (in FIG. 1) in operative position and rolls 85, 86, 87 (FIG. 3) in the inoperative position. All of the rolls 102 of the upper rotatable beams of the shaping stations 20–24 in operative position should thereby touch the plane 106, just as the rolls in the operative position (rolls 85, 86, 87 on the rotatable beam 50 in FIG. 3) were doing with the set-up as shown in FIG. 1. In other words, the rolls in the different rows shall extend equally far out from the turning shaft axis I for each rotatable beam above the strip 91.

On the other hand, in the lower rotating beam of each shaping station, different rows of rolls normally extend at different lengths from the turning shaft axis I of the rotating beam 51 since the profile height is determined by how far these rolls extend above the plane 106. The particular profile height determines the length and will thus vary according to the different profiles. The upper roll 110 in the calibration station 25 is adjusted with a screw 112 in order to provide a final correction to the nominal profile height.

As seen in FIG. 3, the brackets 101 and 76 are alike except for the fact that the holes for the shafts are respectively located at different heights or distances from the shaft axis I to provide the different profile heights since the rolls 82 and 100 have the same diameter as shown. In order to compensate for the smaller width of the roll 82, there is a wider spacer sleeve between the inner rings of the mount and the bracket 76 than there is with the roll 100. In this way, the number of components can be reduced.

Because the preferred machine employs free-forming, no adjustments are necessary for the different strip thicknesses. Between the edge rolls 86, 87 and the rolls 82 (FIG. 3) a play of several tenths of a millimeter is acceptable.

In the preferred embodiment shown in FIGS. 1, 2 and 3, two rows of work rolls have been provided on each rotatable beam. Since the rotatable beams have a square cross section, three or four rows could be mounted thereon if desired. If a rotatable beam with hexagonal cross section is used, it would be possible to have six rows of rolls on each rotatable beam.

The preferred rolling mill machine permits the strip to be cut into desired lengths before shaping instead of after shaping, which is customary. It is advantageous to always cut the flat strip, since no change-over is then needed.

In summing up, one aspect of the invention resides broadly in a rolling mill machine for longitudinal profile bending of thin plate, e.g. for manufacturing of trapezoidal sectioned building plate, comprised of, in part, a number of shaping stations 20–24 with free-rolling work rolls, 82, 85, 100, 102, and in part with drive stations 26–31 separate from the shaping stations set up for feeding the strip, where the work rolls in each shaping station are placed in rows across the strip with a row of rolls 82 on one side of the strip and another row of rolls 85 on the other side of the strip and the work rolls on the one side of the strip placed laterally between the work rolls on the other side so that the strip is shaped by an arrangement of free-forming, characterized by the fact that, in each shaping station 20–24 the row of work rolls 82 on one side of the strip is supported by a first rotatable beam 51, which also supports at least one other row 100 of work rolls, and the work rolls in both of these rows may extend at different distances from the turning shaft of the first beam, the row of work rolls 85 on the other side of the strip being supported by another rotatable beam 50, which also supports at least one other row of work rolls 102, the work rolls in these two rows extending equally distant from the turning shaft of the second beam, and in operative position forming a common operative plane 106 with the corresponding rolls in the other shaping stations, whereby the rotatable beams 50, 51 are lockable in alternative positions where one of the rows of rolls is in operative position while the other rows are swung away out of operative position.

Another aspect of the invention resides broadly in a machine characterized by drive stations 26–31 comprising rolls 32, 38 on each side to grip the strip, where the rolls of the drive stations grip the strip in the common plane 106 and at least a part of the rolls 32 in each station is driven.

Yet another aspect of the invention resides broadly in a machine characterized by drive stations comprising a drive roll 32 on the one side of the common plane 106 and a row of free-rolling counter rollers 38 on the other side of the plane.

A further aspect of the invention resides broadly in a machine characterized by the fact that a row of counter rolls 38 in each drive station 26–31 is supported by a third rotatable beam 37 which also supports at least one other row of counter rolls 39 and that both of the rows of counter rolls extend equally distant from the turning shaft of the third beam, at the same time as the drive roll 32 has surfaces for the cooperation with the counter rolls in all rows, where the second and third beams 50, 37 are situated on the same side of the common plane 106.

A yet further aspect of the invention resides broadly in a machine characterized by the fact that the second and third rotatable beams 50, 37 are situated above the common plane 106.

Yet another further aspect of the invention resides broadly in a machine characterized by the fact that the work rolls are mounted between two roller bearings 83, 84 at axial distance from each other.

An additional aspect of the invention resides broadly in a machine characterized by the fact that the work rolls are mounted on fixed shafts 81 with roller bearings 83, 84 in the side surfaces of the rolls.

A yet additional aspect of the invention resides broadly in a machine characterized by supports 41–46 between at least several of the first stations 26, 20 for support of the strip in the common plane.

A further additional aspect of the invention resides broadly in a machine characterized by outer work rolls 86, 87 in each row of rolls on the one rotatable beam 50 in the shaping stations and its outer work rolls 86, 87 have obliquely positioned surfaces 93 relative to the horizontal plane in order to form the outer edge of the strip.

The invention as described hereinabove in the context of a preferred embodiment is not to be taken as limited to all of the provided details thereof, since modifications and variations thereof may be made without departing from the spirit and scope of the invention.

What is claimed is:

1. A rolling mill machine for bending of plate along the longitudinal axis of the plate as the plate is moved along a path which is generally parallel to the longitudinal axis of the plate through the rolling mill machine to selectively provide one of at least two cross-sectional profiles comprising:

a plurality of shaping stations positioned adjacent to said path of said plate through the rolling mill machine;

at least one drive station for advancing said plate through said plurality of said shaping stations;

each of said shaping stations having first forming means on one side of said plate and second forming means on the other side of said plate;

said first forming means having at least a first set of substantially axially spaced, each of the forming rolls of the first and second sets being mounted on a separate support non-driven forming rolls and a second set of substantially axially spaced non-driven forming rolls, each of the forming rolls of the second forming means being mounted on a separate support plate to form a first of said cross-sectional profiles; and said second set of said rolls of said first forming means for cooperating with said rolls of said second forming means to bend said plate to form a second of said cross-sectional profiles.

2. The rolling mill machine according to claim 1, wherein said plurality of said rolls of said second forming means includes at least a third set of said rolls and a fourth set of said rolls, said second forming means is selectively movable to position at least one of said third and said fourth sets thereof for said bending of said plate, said rolls of said first set are disposed in a transverse direction between said rolls of said third set, said rolls of said second set are disposed in said transverse direction between said rolls of said fourth set, said first set and said third set of said rolls are for cooperating to form said first of said cross-sectional profile, and said second set and said fourth set of said rolls are for cooperating to form said second of said cross-sectional profiles.

3. The rolling mill machine according to claim 1, wherein each of said rolls of said first set and said second set is mounted on axially separated roller bearings.

4. The rolling mill machine according to claim 3, wherein said each of said rolls of said first set and said second set is mounted on a shaft which extends in a transverse direction of said plate and said roller bearings are located at opposite sides of said roll.

5. The rolling mill according to claim 4, wherein said rolls of said first set which are positioned adjacent said one side of said plate and said rolls of said second set which are positioned adjacent said other side of said plate have obliquely positioned surfaces relative to said transverse direction of said shaft to form an outer edge of said plate.

6. The rolling mill machine according to claim 1, wherein said first forming means is selectively rotatable about a first axis to position at least one of said first set and said second set for said bending of said plate and said rolls of said first set and said second set respectively include working surfaces at a predetermined first distance from said first axis to cause said working surfaces to be aligned with a common plane during said bending by said rolls of either of said first set and said second set.

7. The rolling mill machine according to claim 6, wherein said at least one drive station is aligned with said common plane to advance said plate through said plurality of said shaping stations.

8. The rolling mill machine according to claim 7, wherein said drive station is disposed adjacent to one of said shaping stations.

9. The rolling mill machine according to claim 8, further including a plurality of said drive stations and each of said drive stations is respectively disposed adjacent a different said one of said shaping stations.

10. The rolling mill machine according to claim 8, wherein said drive station includes roll means on said one side of said plate and on said other side of said plate for gripping said plate therebetween and at least part of said roll means is driven.

11. The rolling mill machine according to claim 8, wherein said drive station includes a drive roll on said other side of said plate at said common plane and at least one free-rolling counter roll on said one side of said plate aligned with the said common plane for said advancing said plate therebetween.

12. The rolling mill machine according to claim 11, wherein said drive station includes a first set of said free-rolling counter rolls and a second set of said free-rolling counter rolls, said counter rolls of said first set are respectively longitudinally aligned with at least some of said rolls of said first set of said first forming means of said shaping station adjacent thereto, said counter rolls of said second set are respectively longitudinally aligned with at least some of said rolls of said second set of said first forming means of said shaping station adjacent thereto, and said drive station includes selective means for positioning said first set of said counter rolls at said common plane when said rolls of said first set are forming said plate and for positioning said second set of said counter rolls at said common plane when said rolls of said second set are forming said plate.

13. The rolling mill machine according to claim 12, wherein said first set and said second set of said free-rolling counter rolls of said drive station are disposed above said common plane and said first set and said second set of said rolls of said shaping station are disposed above said common plane.

14. The rolling mill machine according to claim 6, wherein said plurality of said rolls of said second forming means includes at least a third set of said rolls and a fourth set of said rolls, said second forming means is selectively movable to position at least one of said third and said fourth sets thereof for said bending of said plate, said rolls of said first set are disposed in a transverse direction between said rolls of said third set, said rolls of said second set are disposed in said transverse direction between said rolls of said fourth set, said first set and said third set of said rolls are for cooperating to form said first of said cross-sectional profile, and said second set and said fourth set of said rolls are for cooperating to form said second of said cross-sectional profiles.

15. The rolling mill machine according to claim 14, wherein said second forming means is selectively rotatable about a second axis set to position at least one of said third set and said fourth set for said bending of said plate and said rolls of said third set and said fourth set respectively include working surfaces at predetermined distances from said second axis to cause said working surfaces to respectively extend beyond said common plane during said bending by said rolls of either of said third set and said fourth set.

16. The rolling mill machine according to claim 15, wherein each of said rolls of said first set, said second set, said third set and said fourth set is mounted on axially separated roller bearings.

17. The rolling mill machine according to claim 16, wherein said each of said rolls of said first set, said second set, said third set and said fourth set is mounted on a shaft which extends in a transverse direction of said plate and said roller bearings are located at opposite sides of said roll.

18. The rolling mill machine according to claim 6, further including support means between at least some of said shaping and said drive stations for support of said plate at said common plane.

* * * * *

UNITED STATES PATENT AND TRADEMARK OFFICE

CERTIFICATE OF CORRECTION

PATENT NO. : 4,903,516

DATED : February 27, 1990

INVENTOR(S) : Sven Olov OLSSON, et al.

It is certified that error appears in the above-identified patent and that said Letters Patent is hereby corrected as shown below:

In Claim 1, line 57, delete the following:

"said first forming means having at least a first set of substantially axially spaced, each of the forming rolls of the first and second sets being mounted on a separate support non-driven forming rolls and a second set of substantially axially spaced non-driven forming rolls, each of the forming rolls of the second forming means being mounted on a separate support plate to form a first of said cross-sectional profiles; and"

In Claim 1, line 57, insert the following in the place of the above-identified text:

--said first forming means having at least a first set of substantially axially spaced non-driven forming rolls and a second set of substantially axially spaced non-driven forming rolls, each of the forming rolls of the first and second sets being mounted on a separate support;

--said second forming means having a plurality of substantially axially spaced non-driven forming rolls, each of the forming rolls of the second forming means being mounted on a separate support;

--said first forming means being selectively moveable to position at least one of said first and said second sets thereof for said bending of said plate;

UNITED STATES PATENT AND TRADEMARK OFFICE

CERTIFICATE OF CORRECTION

PATENT NO. : 4,903,516

DATED : February 27, 1990

INVENTOR(S) : Sven Olov OLSSON, et al.

It is certified that error appears in the above-identified patent and that said Letters Patent is hereby corrected as shown below:

said rolls of at least one of said first set and said second set being disposed for forming said plate on said one side and said rolls of said second forming means being disposed for forming said plate on said other side;

said first set of said rolls of said first forming means for cooperating with said rolls of said second forming means to bend said plate to form a first of said cross-sectional profiles; and--

Signed and Sealed this

Second Day of April, 1991

*Attest:*

HARRY F. MANBECK, JR.

*Attesting Officer*

*Commissioner of Patents and Trademarks*